United States Patent [19]

Gleb et al.

[11] Patent Number: 5,027,589

[45] Date of Patent: Jul. 2, 1991

[54] FOAM RECEIVING ENVELOPE PAD

[76] Inventors: Leslie S. Gleb; Florence E. Gleb, both of 8201 Dorado Canyon Rd., Mt. Aukum, Calif. 95656

[21] Appl. No.: 545,202

[22] Filed: Jun. 28, 1990

Related U.S. Application Data

[63] Continuation-in-part of Ser. No. 497,590, Mar. 22, 1990.

[51] Int. Cl.[5] ..... B68C 1/12

[52] U.S. Cl. ..... 54/66

[58] Field of Search ..... 54/65, 66

[56] References Cited

U.S. PATENT DOCUMENTS

| | | | |
|---|---|---|---|
| 804,671 | 11/1905 | Ransom | 54/65 |
| 894,640 | 7/1908 | Hickman et al. | 54/65 |
| 1,593,672 | 7/1926 | Reynolds | 54/65 |
| 4,136,506 | 1/1979 | Miller | 54/66 |
| 4,683,709 | 8/1987 | Vasko et al. | 54/66 |

FOREIGN PATENT DOCUMENTS

| | | | |
|---|---|---|---|
| 24920 | 11/1936 | Australia | 54/66 |

*Primary Examiner*—Robert P. Swiatek

*Attorney, Agent, or Firm*—Mark C. Jacobs

[57] ABSTRACT

An improved foam receiving envelope pad for use beneath a horse saddle. In one embodiment the envelope pad is interposed between a standard horse pad and the saddle; while in the second embodiment, the envelope pad is integrated into the standard horse pad. In both instances, the construction features the inclusion of an upper surface rearwardly narrowing top gusset followed by an integrated elongated flat panel, the pair of which separate each of two side envelopes from each other. Each envelope in use is downwardly disposed and is adapted to removably receive a special shock absorbing foam insert. The overall configuration of the envelope pad is correlated with the configuration of the saddle for which its use is intended.

5 Claims, 4 Drawing Sheets

FOAM RECEIVING ENVELOPE PAD

RELATIONSHIP TO OTHER APPLICATIONS

This application is a continuation-in-part of our pending U.S. application Ser. No. 497,590 filed March 22, 1990.

BACKGROUND OF THE INVENTION

Pads for use on horses are well known in the equestrian world. These pads are used to prevent chafing and scraping of the saddle against the body, and particularly the back of the horse. Standard or conventional pads may be made of wool or synthetic fibers. Oftentimes they include a pocket for the receipt of saddle flaps, again to prevent chafing of the horse. They are available in a multiplicity of shapes from a plurality of vendors. Generally one buys a pad to match the contour of the saddle. Thus one would not use a pad for an English-type saddle with a western saddle.

Attempts have been made to improve the padding used beneath saddles. One such improved pad is known as the EquiGuard TM, it is a supplementary pad and which is used in conjunction with a Sherpa-Fleece pad and is sold by Libertyville Saddle Shop of Libertyville, Ill. This supplement employs a layer of foam that externally mounts atop the pad. This combination device does little or nothing to prevent the shock from the rider's movements from reaching the horse.

Another saddle pad known to applicant is marketed under the name Flow-Fit by High Horse of P.O. Box 11212 Reno, Nev. This unit comprises an enclosure configured like a tilted pear-shaped slice having a single closeable opening across the front with a pair of spaced opposed mirror image foam members placed within a single enclosure. Numerous problems arise from the use of this pad. Firstly, the two foam pieces often try to override each other since they are confined to immediately adjacent enclosures separated only by a thin seam. The design is not related to either the shape of the horse or the shape of a saddle. While the foam used therein has some shock absorbency, the overall design and construction of the unit causes the foam to quickly deteriorate.

There is a need for a horse pad that will allow the horse's back to breath and which will readily and repeatedly absorb the impact from the rider's movement without rapid deterioration of the impact absorbing material.

It is an object of this invention to provide an improved foam receiving envelope pad for use beneath a horse saddle.

It is another object of this invention to provide a foam receiving envelope pad that permits air to reach and moisture to escape from the horse's back.

Yet another object is to provide a foam receiving envelope pad that is integrated into a conventional saddle pad.

These and other objects of the invention will in part be obvious and will in part appear hereinafter.

The invention accordingly comprises the product possessing the features, properties and the relation of components which are exemplified in the following detailed disclosure and the scope of the application of which will be indicated in the claims.

For a fuller understanding of the nature and objects of the invention reference should be made to the following detailed description taken in conjunction with the accompanying drawings.

SUMMARY OF THE INVENTION

An improved foam receiving envelope pad for use beneath a horse saddle. The device hereinafter referred to as an FREP, may be interposed between a standard horse pad and the saddle; or it may be integrated into the standard horse pad. In both instances, the construction features the inclusion of an upper surface rearwardly narrowing top gusset connected as by stitching to an integrated elongated flat panel, the pair of which separate each of two side envelopes from each other. Each envelope, in use, is downwardly disposed and is adapted to removably receive a special shock absorbing foam insert. Both envelopes and inserts are both contoured to the back of a horse.

DESCRIPTION OF THE PREFERRED EMBODIMENT

Figure 1:
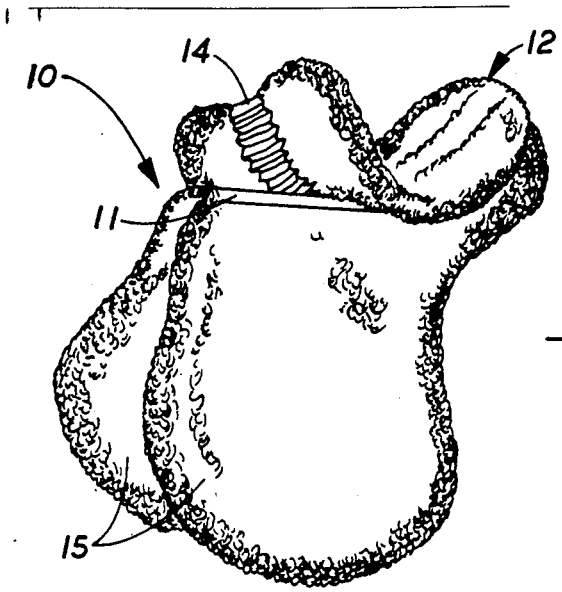
FIG. 1 is a perspective view of the Equi-Guard brand prior art pad used in conjunction with a Sherpa Fleece pad.

Reference should now be made to the Figures. The PRIOR ART device as seen in FIG. 1 and designated 10 comprises a standard saddle pad having two matching side sections 15 separated by a length of material 11. This length of material is capable of engaging the Velcro® strip 14 of saddle support 12. As is seen, the saddle support 12 is formed of a fleece material with this strip 14 on the underside of said support along the length thereof. The saddle rests on the saddle support.

Figure 2:
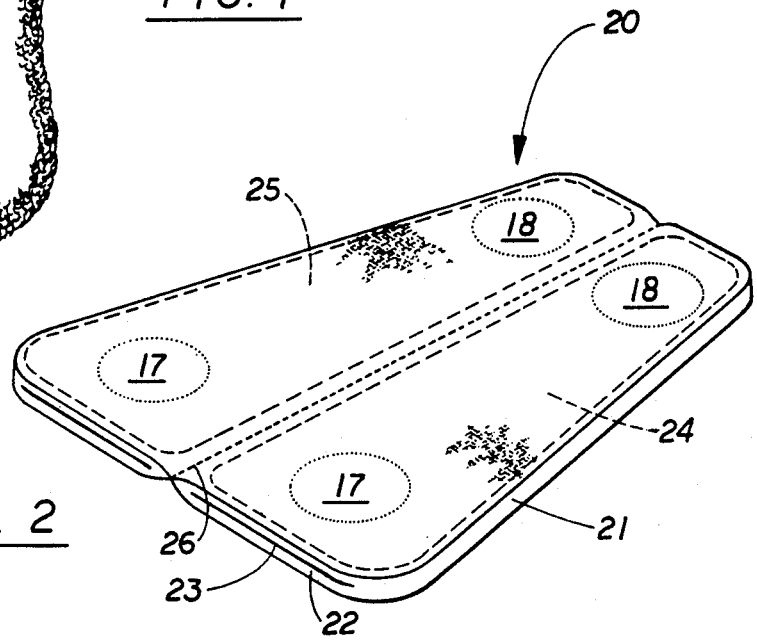
FIG. 2 is a top plan view of the Flow-Fit prior art brand saddle pad.

FIG. 2 pertains to a second prior art structure, 20 namely the one emanating from Reno. This device comprises a one piece bag 21, that is closed on three sides and which on its fourth side 22 has a Velcro® or related closure to permit placement of a pair of mirror image foam members therein through slot 23 into subsections of the bag. These foam members 24, 25 are shown in dashed line in their respective subsection of the bag 21. The two subsections are stitched together along central seam 26 which connects the upper surface to the lower surface thereof. Typically bag 21 is made of a Lycra Spandex® material. Users of this device have reported significant foam deformation and stress at the dotted circle areas 17, 18. Thus this product has been reported to have a short life span. To use it, one merely folds the device up or down as may be desired along the central seam 26 and then places the saddle on the top of same.

Figure 3:
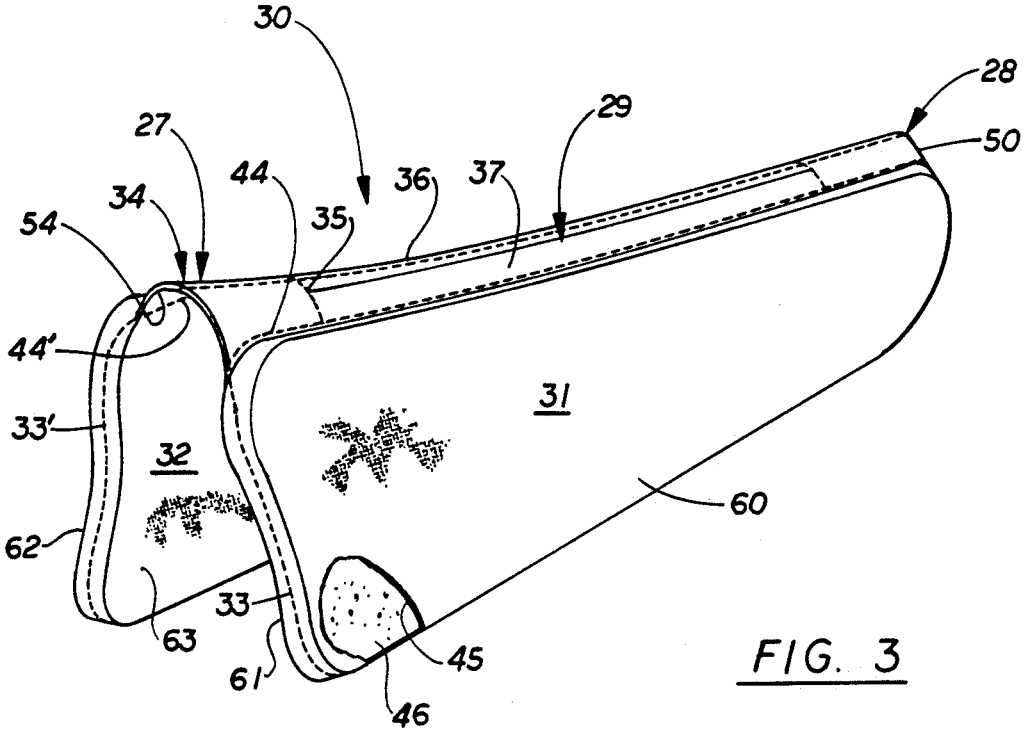
FIG. 3 is a perspective view of the first embodiment of the foam receiving envelope pad of this invention.

The discussion now turns to the first embodiment of this invention as seen in FIG. 3. Here device 30 is seen to comprise two side envelopes or sections 31, 32, which depend downwardly from a top section 29, and which will be discussed infra.

Figure 5:
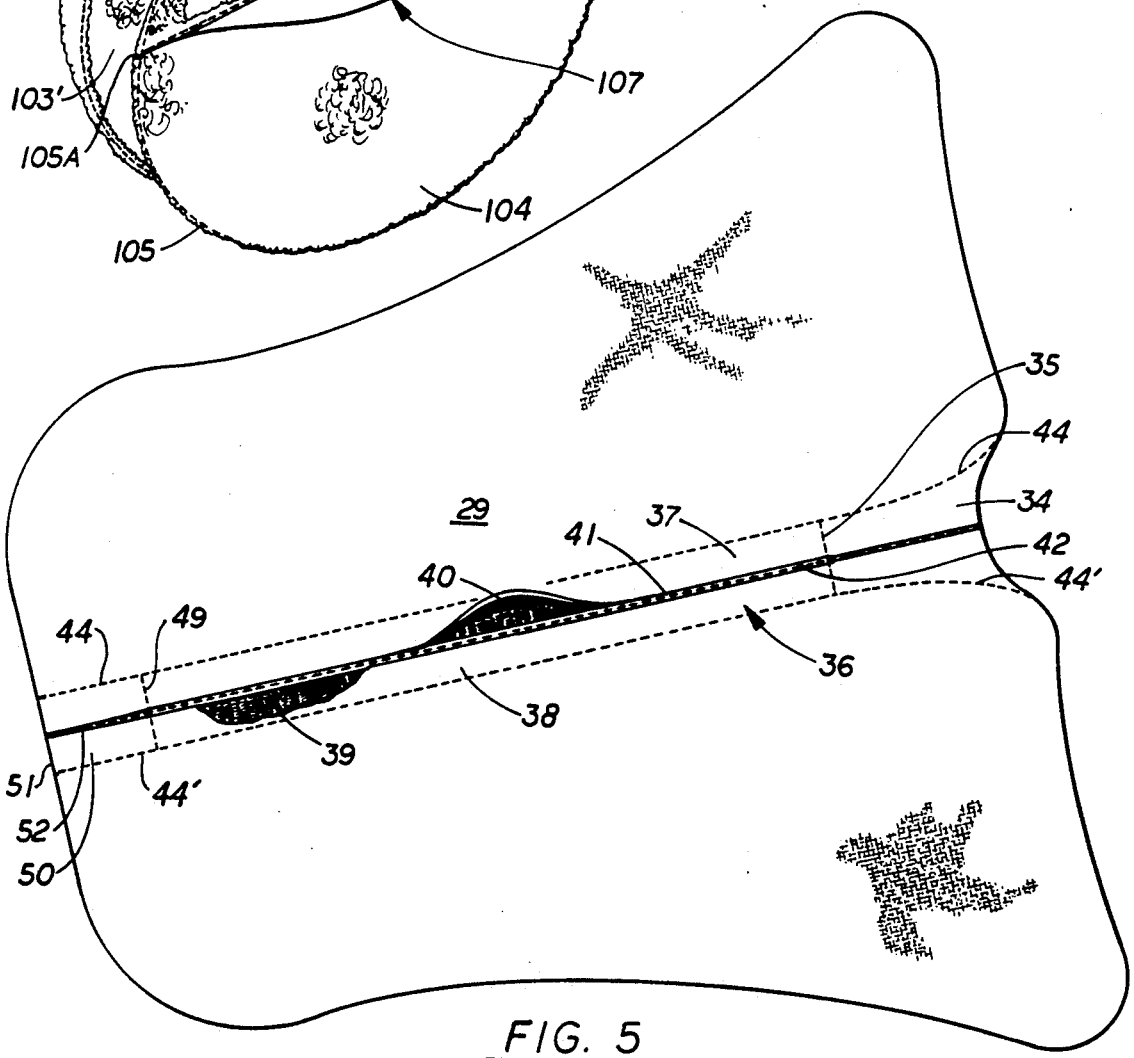
FIG. 5 is a top plan view of the first embodiment of this invention.

Top section 29 includes a gusset means 27, comprising a rearwardly narrowing top front gusset 34, which can also be seen in FIG. 5. Gusset 34 is defined by the side seams 44, 44' and cross seam 35. Top section 29 also includes first panel 36, and a second panel to be discussed below. This first panel comprises left and right fabric strips 37, 38 each of which has an underside layer of a hook and pile fibrous fastener, either the male hook or female fiber layer, with a slot or opening 42 there between. One of the layers of the hook and pile fastener is found on surface 41, which constitutes the interior side of panel 48 per FIG. 6. Surface 41 includes the two spaced fastener layers with fabric in between. Seam 43 best seen in FIG. 6 goes through and may be seen also in FIG. 5 as the dashed line corresponding to the slot opening of 42. Such hook and pile fastener means are widely available under the Velcro ® trademark and are seen to comprise two attaching strips, one of stiff fibers resembling a carpet and the other a strip comprising a large plurality of hook-shaped fibers. These strips mate together firmly but are not inseparably engaged upon being pressed together. Disengagement is effected by a hand peeling force. Reference is made to U.S. Pat. No. 4,047,250 for more details.

With specific reference here, the cutaway section 39 comprises the hook layer. Each strip 37, 38 is stitched to its respective side section along seams 44, 44' per FIG. 3. In point of construction, each strip may comprise a finite piece or be formed integrally with the fabric of its respective side section, and defined merely by the seams 44, 44'.

Tail means 28 (see FIG. 3) comprises the first or outer tail 50 and the second inner tail 58 which is on the bottom side of the device and is coextensive with tail 50. Tail 50 is defined by side seams 44 and 44', second cross seam 49 and the rear edge 51. It comprises the two strips 37 and 38 sewn together along what would be the continuation of slot 42, the seam extension of which is designated 52.

Figure 6:
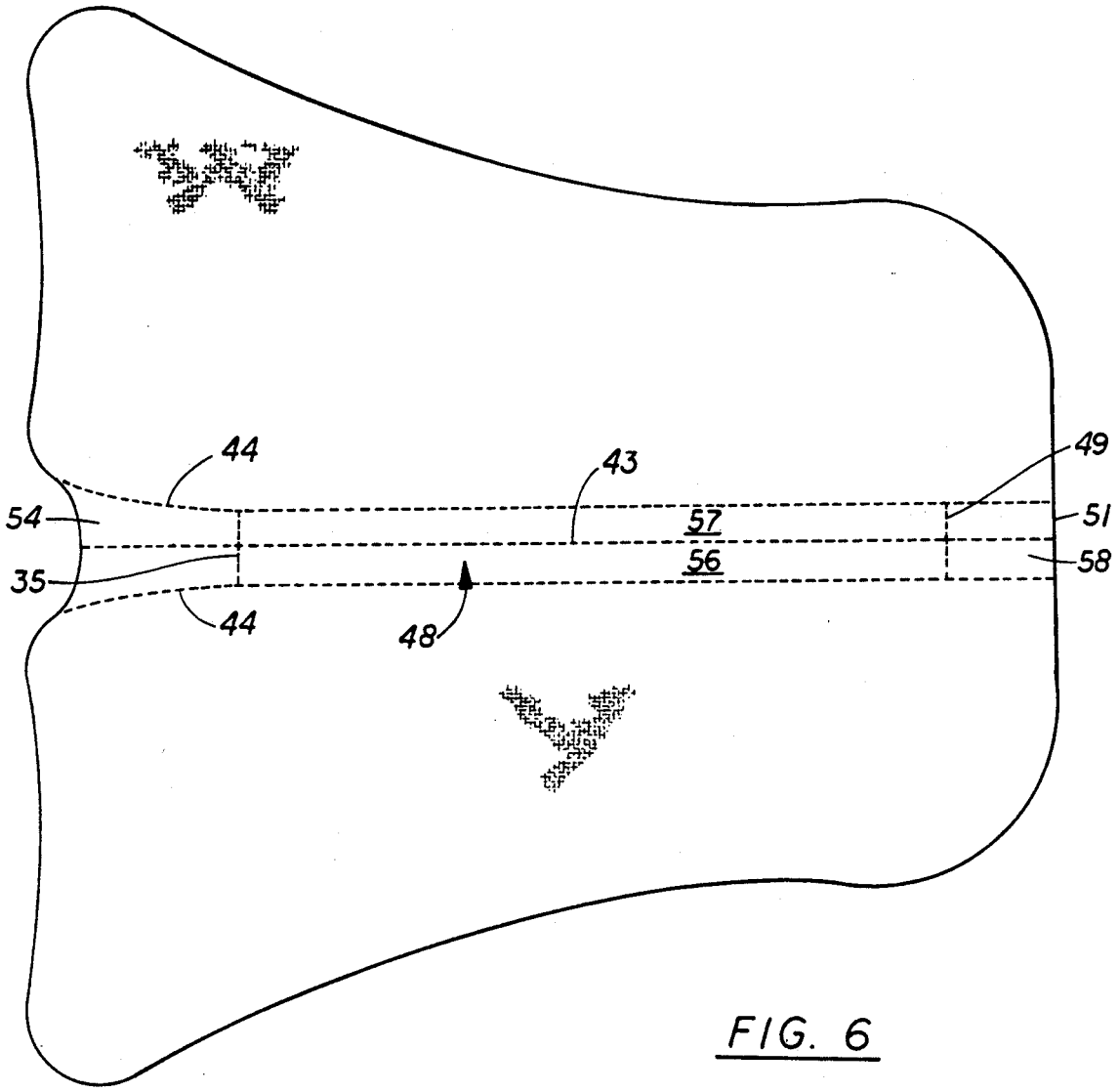
FIG. 6 is a bottom plan view thereof.
Figure 7:
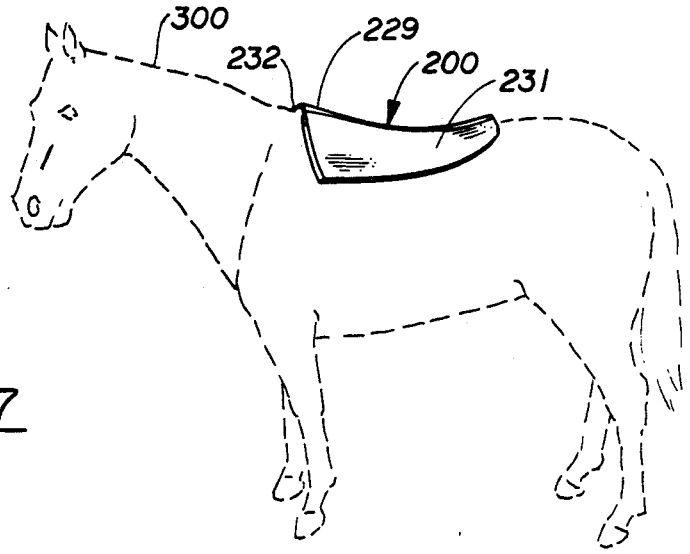
FIG. 7 is a diagrammatic view showing a device of this invention contoured to the back of a horse.

Reference should now be made to FIG. 6, the underside of the device. The gusset means 27 also includes second gusset 54 coextensive with first gusset 34, and having as its inner edge, a limit defined by the cross seam 35. Like the first gusset, the second gusset can be formed from an extension of the material used for the side sections or formed as a separate component and then sewn into place. Second panel 48 comprises two elongated strips 56, 57 sewn together along center seam 43. On the inside of each strip 56, 57 as seen in the cutaway of FIG. 5 is the opposite gendered mating member of the hook and pile fabric fastening means, here designated 40. A second tail section 58 coextensive with first tail section 50 comprises the extension of the two strips 56, 57 between seam 49 and rear edge 51.

Reference should now again be made to FIG. 3 for the discussion pertaining to the side sections or envelopes 31, 32. These two sections or envelopes are each formed of two coextensive panels; namely 60, 61 and 62, 63 respectively. The panel pairs are sewn together along the exterior at periphery seam 33 and 33' respectively and at the top along side seam 44 and 44' respectively. These side sections 31, 32 have an interior chamber 45 for receiving a foam insert 46.

In general the vertical leading edge of the side sections is of greater elevation than that of the trailing edge. There is however no specific relationship of one to the other. The point being that commercial success has been had with the FREPS of this invention because we have configured the pad to a specific type of saddle with which the FREP is to be employed in addition there has been commercial success because the FREP, no matter the saddle type, is contoured to fit the back of a horse. See the Figures.

Thus it is recognized among equestrians that the main saddle types include among others dressage; jumping or forward seat; all purpose; show; American endurance; Australian endurance; English and Western. In all of these the side skirt configuration and their location on the saddle vary. Applicants' pads conform to these variations. Thus by reference to FIG. 8 it is seen that there is no defined relationship between the leading and trailing edge in either elevation or angularity for the foam inserts utilized in this invention.

Reference should now be made to this 8th FIG. Here six different patterns are set out for the foam inserts that fit into and conform in shape to envelopes 31, 32. (Obviously the numbers 31, 32 are exemplary sinCe in reality, the envelopes are configured the same as the foam insert, what ever shape that might be.) These have been labeled, I; II; III; IV; V and VI. Insert I would be used in an FREP intended for use with a Western saddle. The shape of II is for use with an Australian endurance saddle. The highly inclined leading edge model III is for use with a close contact saddle.

The unit configured with a vertical leading edge and a rearwardly inclined second edge, model IV is for use with an arabian show horse saddle. The next unit, V, is for a dressage saddle. Whereas the foam insert configuration VI which corresponds to the shape of the envelope of FIG. 3 where it would be inserted is for use with an all purpose saddle.

Up until this time no mention has been made of the nature of the material used in the foam inserts 46. Since the material used here is the same as used in the device of the next embodiment, discussion will be reserved till later, on this aspect of the invention.

Figure 4:
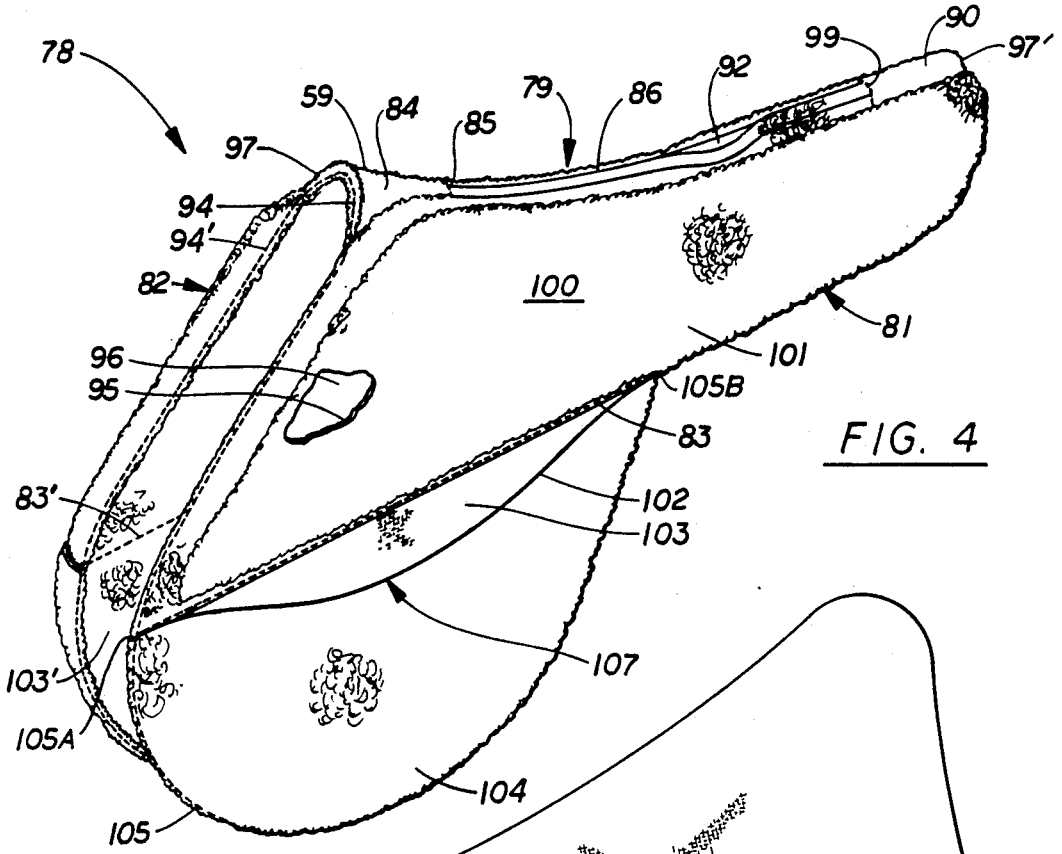
FIG. 4 is a perspective view of a second embodiment of this invention.

The reader's attention is now turned to FIG. 4, which depicts the second embodiment of this invention. Here the FREP features are integrated into the construction of a conventional saddle pad. This device 78 comprises a top section 79, which is similarly constructed as the top section 29 of the previous embodiment, in having gusset means, first and second elongated panels and tail means, and which top section is connected to a pair of side sections 81, 82.

Top section 79's gusset means 59 includes the inwardly narrowing gusset 84 defined by front edge 97, side seams 94 and 94' this last not being visible in FIG. 4, and cross seam 85. A first panel 86 extends therefrom to the tail 90 which commences at the end thereof, i.e., second cross seam 99 to rear edge 97'.

The side sections 81 and 82, or envelopes, are each formed of two coextensive panels; namely 100, 103 and 100' (not seen) and 103' respectively. The panel pairs are sewn together along the exterior at periphery seam 83 and 83' respectively and at the top along side seam 94 and 94' respectively. These side sections 81, 82 have an interior chamber 95 for receiving a foam insert 96.

Whereas the envelope or chamber in the first embodiment was coextensive with the interior dimensions of the total pad such is not the case here. Here seam 83 the periphery seam defines three sides or edges of the chamber 95 for receipt of the foam insert 96, which insert is configured in like fashion. See FIG. 4.

Thus it is to be seen that the outer side panels 100, 100' are comprised of first portion 101 which includes therein the envelope aforesaid, access to which is gained through slot 92 in top section 79; and these outer side panels also include lower portion 104. Lower portion 104 is seamed to the inner panel along edge seam 105 which runs between two different point locations on the periphery seam 83, which is the periphery of the envelope, around the remainder of the outer edge of the side panel, namely from point 105A to point 105B. Seam 83 defines the bottom edge of first portion 101 adjacent open or unstitched top edge 102 of pocket 107.

A pocket 107, which is open at top edge 102, is defined by the lower portion 104 which is stitched to inner panel 103 along said edge seam 105. The inner panel 103 can be seen in the cutaway of the pocket. This pocket 107 is intended to receive side skirts from the saddle. Such pockets are well known since they appear in conventional saddle pads.

The inner panel 103' is also seen in this Figure. It comprises a full one piece panel coextensive with the combination of over panel 100's first portion in combination with the pocket forming lower portion, 104.

A second tail section 91, not seen, but coextensive with first tail section 90 comprises the extension of the sewn two strips between second cross seam 99 and rear edge 97'.

The device of this embodiment may be made of any material such as fleece, cotton or other breathable materials. While the second embodiment has been described as having pockets 107, it is also to be understood that a similarly configured FREP can be made without the pockets.

Also, the pocket area 107 is seen to have an arcuate bottom edge. It is also contemplated to employ a pocket area with a more squared off pocket as well.

The discussion turns now to the special foam that is employed for the inserts 46 and 96. This foam is a medium density, open-celled polyurethane foam which is capable of absorbing up to about 90+ percent of impact energy without bottoming out. In addition to high impact absorption we require a slow rate of return from deflection. Minimal energy is to be returned to the impacting body. Such a foam is sold under the brand name Confor TM foam by Specialty Composites Corporation. We have found that the company's C-47, C-50 and C-52 foams provide the amount of stiffness and load carrying ability that give the best results.

Some of the physical characteristics for the least stiff of the three, namely C-47 include:

Density — 102.4 kg per cu m
Tensile Strength — 45 psi
Ultimate Elongation — 17%
Compression set at 50% — 1%
Indentation Force Deflection 25% IFD value — 65 ILD Pounds The chief reason why these foams work best is that their use eliminates pressure points because under pressure the foam cells partially collapse to equalize the pressure over the entire bearing surface. Pressure is distributed evenly over the entire contact area of the horse. This way, the saddle does not ride on high points on the horse thus causing further abrasion and irritation to the horse. Since this foam softens on contact with a warm body, i.e. the horse, pressure is readily distributed over the entire area of the pad. Even after prolonged use there is a complete return to its original form even after 90% compression.

While the medium stiffness grade, C-45, which is blue in color, could be employed, we find that the C-47, 50 and 52 are far superior. We have also utilized a medical grade of the C-47 foam, which is designated T-47. It has a lower density of 91-96 kg/cu. m. The tensile strength of T-47, which is green, is 21 psi.

We readily believe that we are the first foam receiving envelope pad to use the maximum stiffness C-47 foam for the inserts and we know we are the first to use C-50 and 52 foam. At best the competition utilizes a blue grade.

Figure 8:
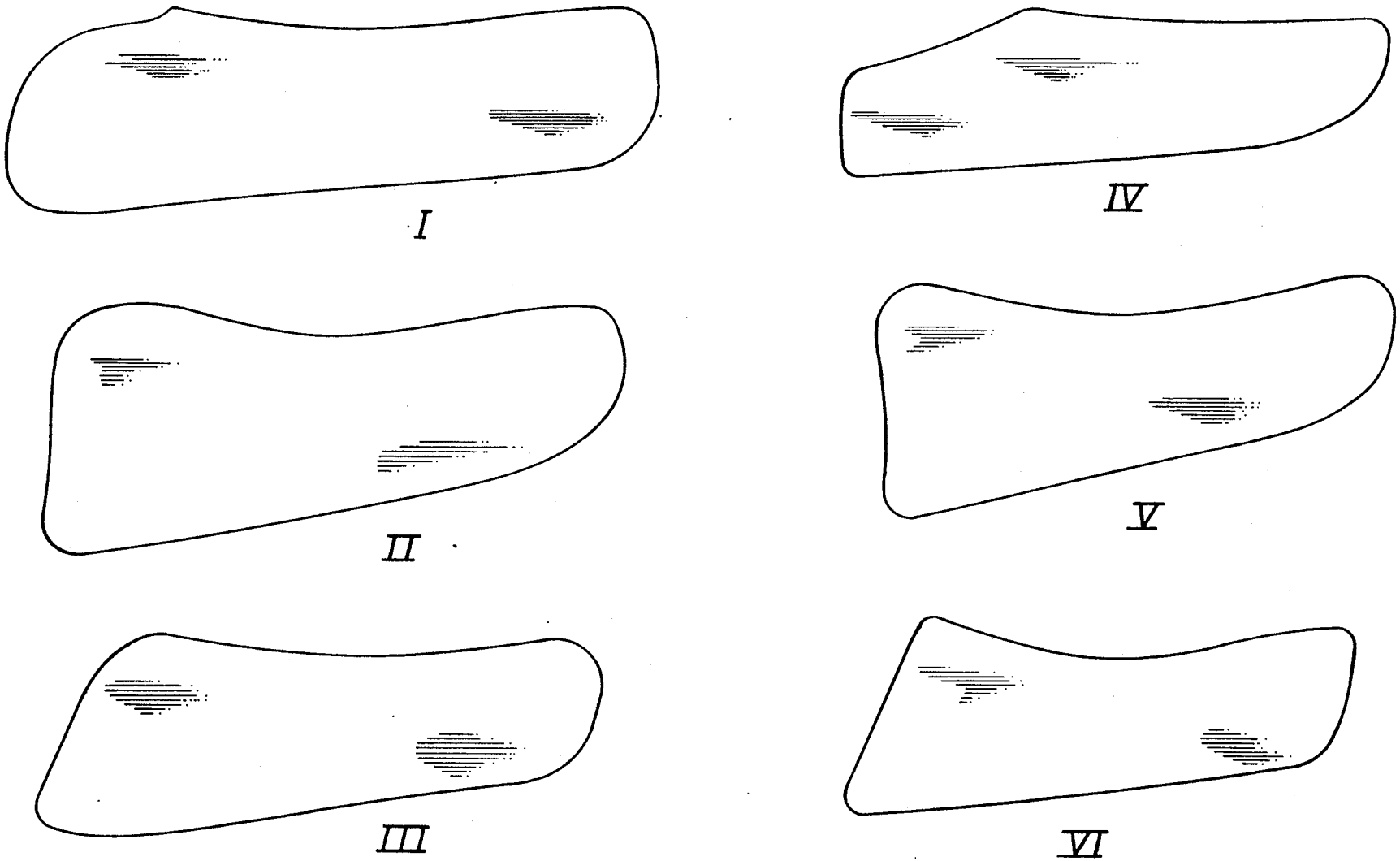
FIG. 8 is a diagrammatic presentation of the configuration of various foam inserts for use in the envelopes of this invention configured to correspond to the disposition and shape of side skirts of various types of saddles.

References should be made to FIG. 8. Here it is seen that the FREP 200 has its top section 229 resting easily on the back of a horse 300. The two side sections 231 and 232 depend gently down from the top section. The molding to the curvature of the back of a specific horse arises from the molding on the inserts by the pressure from the legs of the rider.

In recapitulation what sets our pads apart from other FREPs of the marketplace are the following:

a. The gusset as seen in FIG. 4 creates a gap which allows air to enter and move along the back of the bone of the horse, when the device is in position for utilization.

b. The use of the top section to segregate the two side sections from each other such that the side sections will lay better on the sides of the horse.

c. The top location of the access to the envelope, which prevents the inserts from attempting to carry out the peeling operation to break open the Velcro ® bond during frontal lurches, jumps and other moVes. There is better confinement of the insert within the chamber or envelope because the saddle prevents the foam from moving upward and outward.

d. The conforming of the total pad shape, FIG. 3, or the insert portion and its envelope in the integrated pad, FIG. 4, to the specific style of saddle to be utilized therewith for maximum shock absorption.

e. The contouring of all FREP's, no matter which saddle style a particular one is designed to be used with, to the back of a horse. See FIG. 8.

Since certain changes may be made in the above apparatus without departing from the scope of the invention herein involved, it is intended that all matter contained in the above description and shown in the accompanying drawings shall be interpreted as illustrative and not in a limiting sense.

We claim:

1. A foam insert receiving envelope pad for use on a horse's back in an interposition disposition between a saddle and a saddle pad, for absorption of impact shock and vibration generated by a rider to a horse, during equestrian athletic events, which insert pad comprises a generally inverted U-shaped device having an elongated top section and a pair of side sections said top section comprising rearwardly narrowing gusset means connected to a first upper panel and a second lower panel, said panels being coextensive, and tail means;

said first panel comprising left and right fabric strips, each of which has an underside layer of a hook and pile fibrous fastener, either the male hook or female fiber layer with a slot between said fabric strips, each of said strips being secured along the edge opposite the slot to its respective side section;

said second panel comprises two elongated strips sewn together along a center seam, and on the inside of each strip of said second panel is a layer of the opposite gendered mating member of the hook and pile fibrous fastener;

said tail means comprising first and second tail sections each of which comprises the extension of the fabric strips of its respective panel sewn together along adjacent edges, and extending to a rear edge of the device;

each side section being configured to the shape suitable for use with a specific saddle type, and formed from two pairs of mirror image coextensive panels, said panel pairs being sewn together along a periphery seam and being sewn at the top to the top section along side seams to thereby form an interior chamber in each side section for receiving a foam insert similarly configured;

and a foam insert, configured to fit within the confines of said envelope, disposed therein; wherein said foam insert is a medium to firm density, open-celled polyurethane foam which is capable of high impact energy absorption with a slow rate of return from deflection.

2. The device of claim 1 wherein the foam insert is a medium to firm density, open-celled polyurethane foam which is capable of absorbing up to about 90 plus percent of impact energy without bottoming out.

3. The device of claim 2 wherein the foam is selected from the group consisting of the C47, C50 and C52 open celled polyurethane foams capable of high impact energy absorption sold under the brand name Confor Foam.

4. The device of claim 1 wherein the side sections are incorporated into a standard saddle pad.

5. The device of claim 4 wherein the foam insert is a medium to firm density open-celled polyurethane which is capable of absorbing up to about 90 per cent of impact energy without bottoming out.

* * * * *